US005327749A

United States Patent [19]

Junger

[11] Patent Number: 5,327,749

[45] Date of Patent: Jul. 12, 1994

[54] CIRCULAR KNITTING MACHINE CREEL

[75] Inventor: Reiner Junger, Friedberg, Fed. Rep. of Germany

[73] Assignee: Ernst Jacobi GmbH, Gersthofen, Fed. Rep. of Germany

[21] Appl. No.: 26,778

[22] Filed: Mar. 5, 1993

[30] Foreign Application Priority Data

Apr. 6, 1992 [DE] Fed. Rep. of Germany ... 9204737[U]

[51] Int. Cl.[5] ..... D04B 15/40; D04B 35/30

[52] U.S. Cl. ..... 66/125 R; 15/301; 15/312.1; 66/168; 242/131

[58] Field of Search ..... 66/125 R, 168; 15/301, 15/312.1; 242/131

[56] References Cited

U.S. PATENT DOCUMENTS

| | | | |
|---|---|---|---|
| 3,237,236 | 3/1966 | King, Jr. | 15/312.1 |
| 3,459,010 | 8/1969 | Ferri | 15/301 |
| 4,484,434 | 11/1984 | Rümmele | 15/312.1 X |
| 4,540,138 | 9/1985 | Gutschmit | 66/125 R X |
| 4,768,443 | 9/1988 | Bruggisser et al. | 15/312.1 X |
| 4,903,367 | 2/1990 | Brunner | 15/301 |

FOREIGN PATENT DOCUMENTS

| | | | |
|---|---|---|---|
| 1151107 | 7/1963 | Fed. Rep. of Germany | 15/312.1 |
| 1273557 | 9/1961 | France | 66/168 |
| 248140 | 8/1969 | U.S.S.R. | 66/168 |
| 271703 | 9/1970 | U.S.S.R. | 66/168 |
| 367195 | 3/1973 | U.S.S.R. | 66/168 |

*Primary Examiner*—Clifford D. Crowder
*Assistant Examiner*—John J. Calvert
*Attorney, Agent, or Firm*—Pascal & Associates

[57] ABSTRACT

A circular knitting machine creel for a plurality of bobbins which are supported in tiers by a circular cylindrical frame, comprising a carrier located inside the frame, at least one blower supported by the frame, having an air outlet connection directed somewhat radially outward, the blower moving on a circular path whose axis coincides essentially with the axis of the frame.

28 Claims, 2 Drawing Sheets

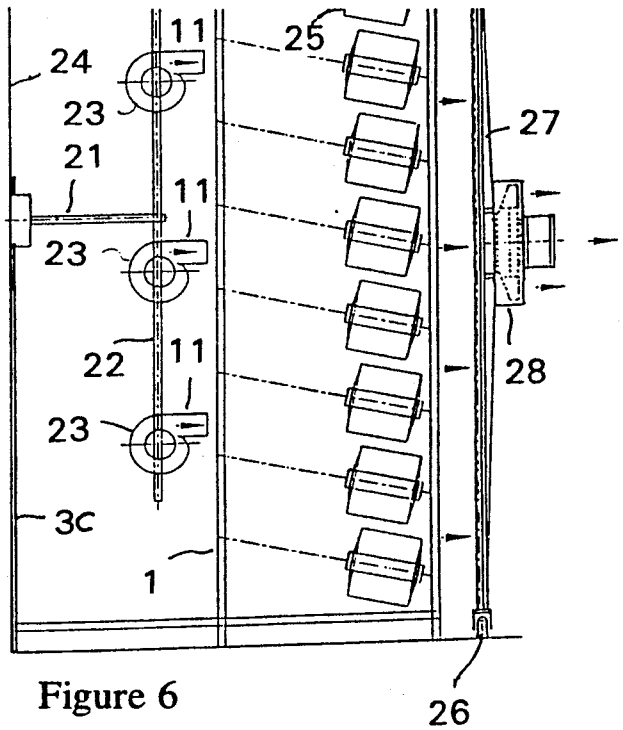
Figure 6
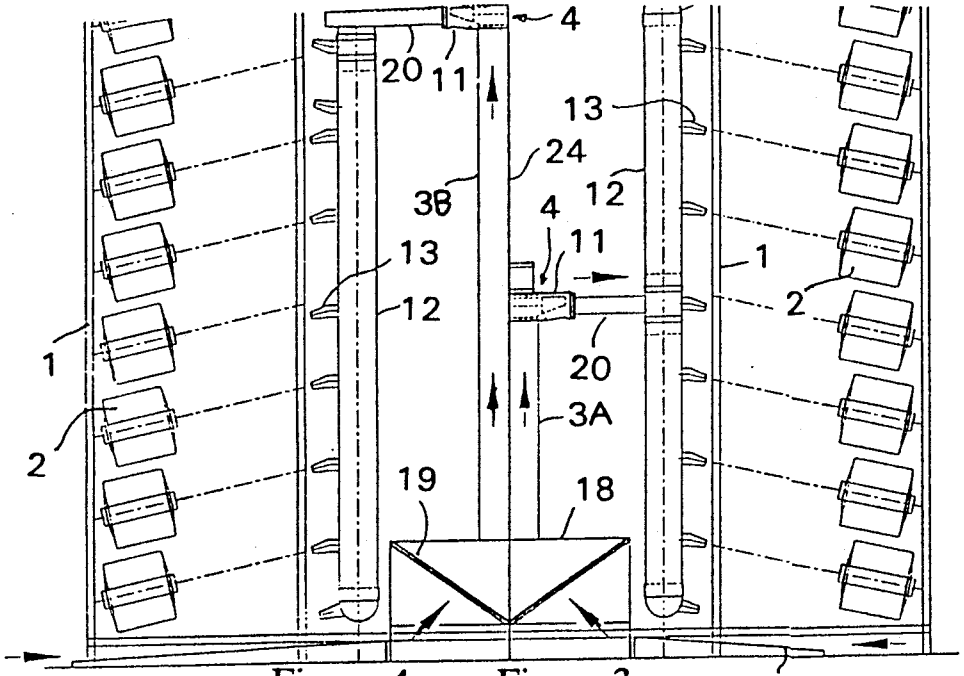
Figure 3
Figure 4
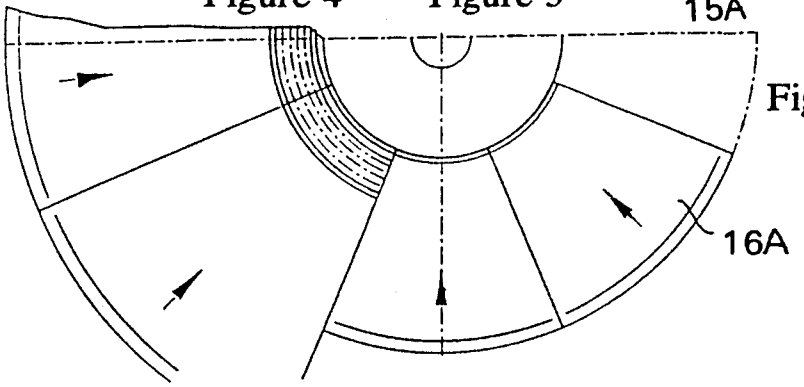
Figure 5

CIRCULAR KNITTING MACHINE CREEL

FIELD OF THE INVENTION

This invention relates to a circular knitting machine creel.

BACKGROUND TO THE INVENTION

Circular knitting machine creels are bobbin frames in which a number of bobbins are arranged in a circle and in tiers above one another. Threads drawn off from the bobbins are fed to knitting machines. When threads are drawn off, fuzz is produced which collects on parts of the frame and on the floor and makes it necessary to clean the frame and floor area periodically. Unavoidably, fuzz collects on parts of the frame, and an accumulation often comes loose from the frame and is carried along by a thread. This can result in a fuzz accumulation being embedded in the stitches of the knitwear and perhaps lead to substandard knitwear. Embeddings of this type can usually be easily seen since there are bobbins of different colours on the bobbin frame.

SUMMARY OF THE INVENTION

An object of the present invention is the construction of a circular creel such that continuous cleaning of the frame and bobbins is assured.

In accordance with a preferred embodiment, a circular knitting machine creel for a plurality of bobbins which are supported in tiers by a circular cylindrical frame, is comprised of a carrier located inside the frame, at least one blower supported by the frame, having an air outlet connection directed somewhat radially outward, the blower moving on a circular path whose axis coincides essentially with the axis of the frame.

BRIEF INTRODUCTION TO THE DRAWINGS

Embodiments of the invention are described in greater detail below with reference to the drawings, in which:

FIG. 3 is a vertical section through the right part of a creel according to a second embodiment;

FIG. 4 is a vertical section through the right part of a creel according to a third embodiment;

FIG. 5 is a top view onto the floor group according to the second and third embodiment, and FIG. 6 is a vertical section through the right part of a creel according to a fourth embodiment.

DETAILED DESCRIPTION OF THE INVENTION

Figure 1:
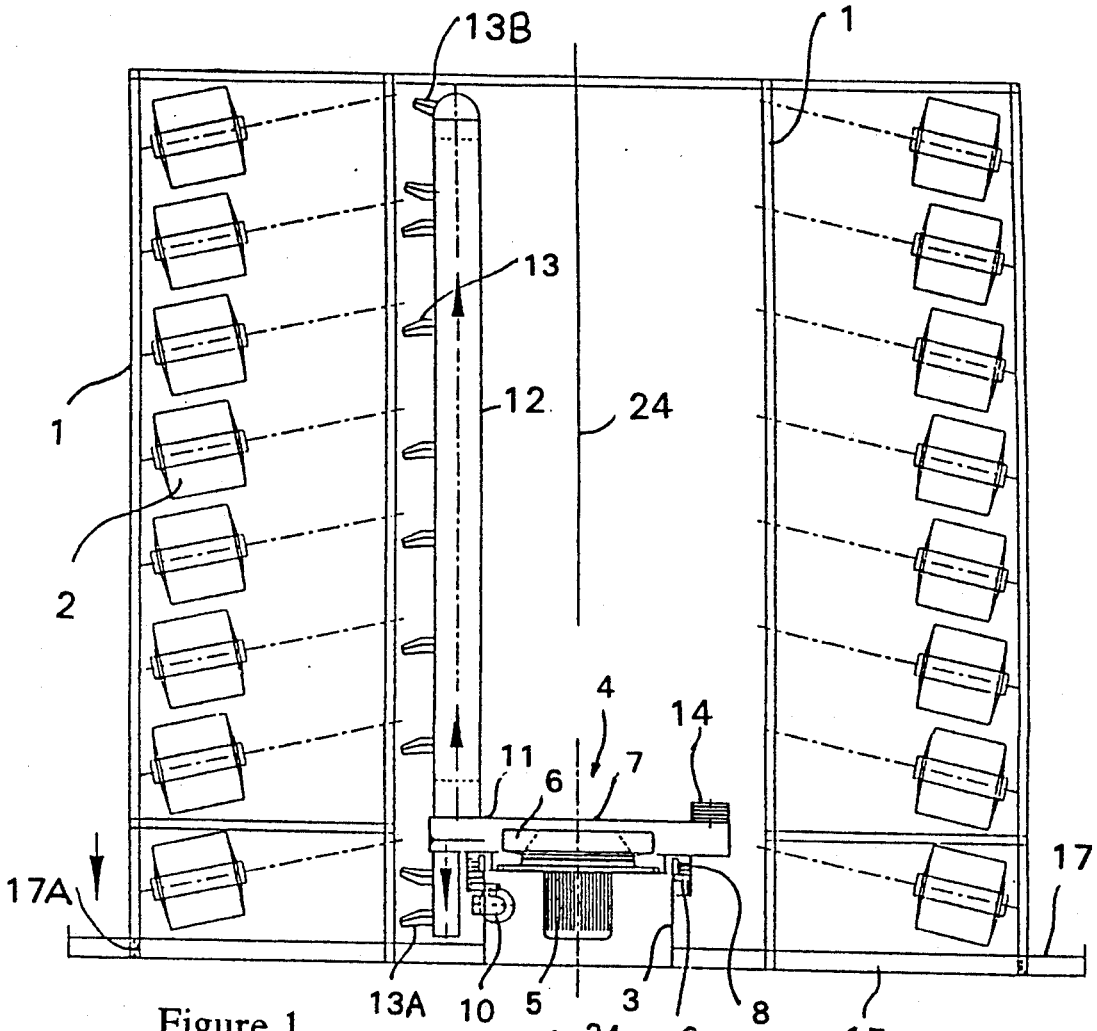
FIG. 1 is a vertical section through a circular creel according to a first embodiment.
Figure 2:
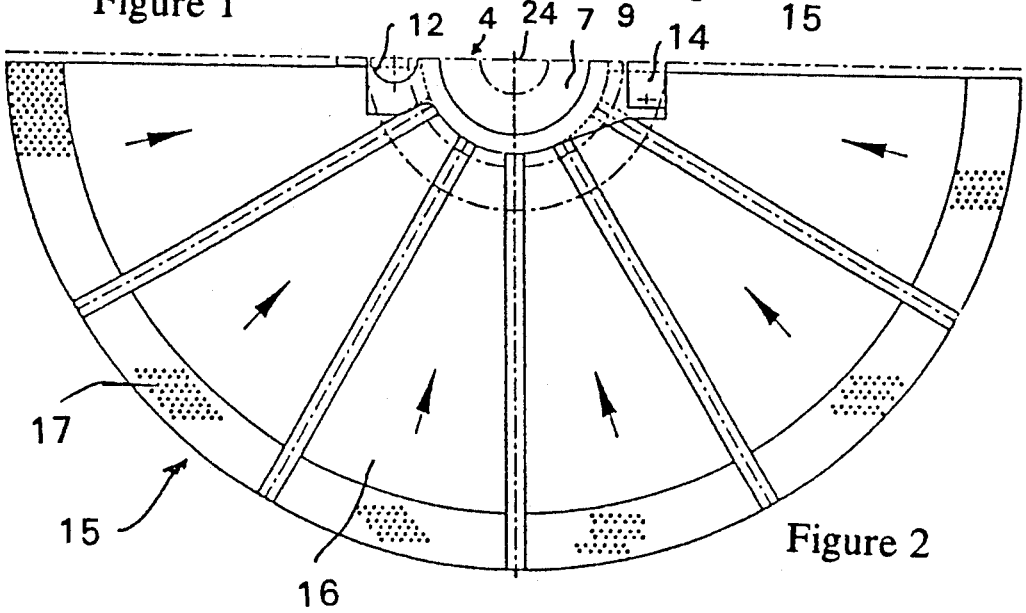
FIG. 2 is a top view of the cleaning part of FIG. 1.

As shown in FIG. 1, a circular creel is comprised of a frame 1 which is hollow-cylindrical and supports a number of bobbins 2 which are arranged in a circle and in tiers above one another. Inside the frame, there is a socket-like carrier 3 which supports a blower 4. Carrier 3 is hollow and carries an electric motor 5 for driving a fan wheel 6. A spiral housing 7 of the blower 4 supports several impellers 8 on its underside which have horizontal swivel axes extending radially to one another. These impellers roll off of a blade rim 9 of the carrier 3.

A drive motor 10 is located on carrier 3 which is engaged with a drive rim on the blower housing 7. The blower housing 7 has an air outlet connection 11 which is directed radially outward and ends in and supports an air-blast hose 12. The air-blast hose 12 has a length which is slightly shorter than the height of the thread-guiding tubes extending above the frame 1. Air-blast hose 12 is provided with a number of blast nozzles 13 each of which is directed radially outward in direction of one of the circular rows of bobbins. Furthermore, a blast nozzle 13A is provided at the lower end of the blast hose and which points in the direction of the floor area of the frame, whereas another blast nozzle 13B is provided at the top and which points in the direction of the upper end of the frame.

Housing 7 has a counterweight 14 on its side opposite the blast hose 12.

A floor group 15 is provided which is divided into segments 16 separated from one another. Segments 16 protrude beyond the frame 1 on the outside and are provided with a filter or screen 27 on their protruding parts. The protruding parts of the segments 16 can also be omitted, so that the segments 16 close flush with the frame 1. In this case, each segment has a screen 17A on its front end. Segments 16 extend up to the carrier 3 and communicate with the inside of the carrier. A cover plate can be connected to the air-blast hose 12 which covers the inside orifice of individual segments 16.

When the drive motor 10 is actuated, it turns the spiral housing 7, as a result of which the blast hose 12 describes a circular path inside the frame 1. The air drawn in by the fan wheel 6 passes through screens 17 or 17A, flows through the segments 16 of the floor group 15 and reaches inside the carrier 3. The air conveyed by fan wheel 4 is supplied to the blast hose 12 via air outlet connections 11 and passes out via the blast nozzles 13, 13A and 13B. This causes a blowing on the bobbins 2 as well as the floor and top area of the frame 1 and the thread-guiding tubes. As a result, continuous cleaning of the frame 1 and the bobbins 2 take place. Flying fuzz in the inlet air is essentially caught by screens 17 or 17A and thus does not reach the blast air current. If a cover plate covering the segment openings and circulating with the air-blast hose 12 is provided, then the suction current is concentrated on the uncovered segments and thus the floor area is very intensively cleaned.

Instead of the counterweight 14, a further blast-air hose 12 can be provided in its place, whereby it is then advantageous to construct the housing 7 in the form of a double spiral housing with another air outlet connection which ends in and supports a further blast-air hose 12.

If the blower housing 7 is constructed so as to be relatively light, for example if it consists of plastic, then it is possible to provide one or more additional nozzles 13 on the blast-air hose 12, which are not, however, directed radially outward but are directed essentially tangentially. As a result, the blower housing 7 with the blast-air hose 12 is set rotating by recoil in these nozzles. In this case, the drive motor 10 can be omitted.

As shown in FIG. 3, the carrier 3A is constructed in the form of a column which is hollow on the inside. It carries the blower 4 on its upper side, as described above. Carrier 3A is supported by a filter box 18 which has a conical screen 19 on its inside, the tip of which points downward. The carrier 3A interior is connected to the interior of the filter box 18. The interior of the filter box 18 is, in turn, connected to the segments 16A of the floor group 15A. The interior of the segments 16A and the interior of the carrier 3A are separated from one another by the screen 19 in the filter box 18. Segments 16A are inclined from the outside inward.

A pipe 20, which opens in the air-blast hose 12, extends horizontally from the air outlet connection 11 of blower 4. The filter box 18 and the carrier 3A supported by it together have a height which corresponds to approximately half the height of the frame 1.

The embodiment of FIG. 4 essentially differs from that of FIG. 3 in that the columnar carrier 3B together with the filter box 18 occupies a height which is slightly less than the height of the frame 1. The blast-air hose 12 is suspended on pipe 20.

In the embodiment of FIG. 6, carrier 3C is constructed in the form of a rod and pivots a horizontal rotating arm 21 which, for its part, supports a vertical support arm 22. Several blowers 23 are placed below one another on this vertical support arm, the air outlet connections 11 of which are directed radially outward.

Common to the above-noted embodiments is that the air-blast hose or the blower 23 rotate about a vertical axis 24 which coincides with the vertical axis of the frame 1. Thus, all the bobbins 2 and the frame 1 are uniformly blown against with blast air on all sides.

In the embodiment of FIG. 6, a rail 25, on which a carriage 27 is supported on rollers and which has rollers 26 running on the floor, is provided on the outside, and alternatively or in addition, on the upper side of the frame 1. Carriage 27 is provided with a blower 28 which produces a suction air current away from the frame 1. The carriage 27 travels about the frame 1, driven by a drive which is not shown, and thereby draws off flying fuzz from the frame 1 and the bobbins 2.

I claim:

1. A circular knitting machine creel for a plurality of bobbins which are supported in tiers by a circular cylindrical frame having a vertical axis, a hollow carrier located inside the frame, a blower having an electrical motor, a fan wheel driven by the electric motor and a blower housing with a suction port and at least one air outlet port, the electric motor being carried by the carrier and the blower housing being pivoted by the carrier for moving on a circular path around the vertical axis, a first air-blast hose extending parallel and at a distance to the vertical axis, connected to the air outlet port and having a length corresponding to the height of the frame, a plurality of air nozzles on the air-blast hose which are radially outwardly aligned with respect to the vertical axis, and a floor group on which the frame is located, which is hollow at the bottom and which communicates with the inside of the carrier in which the suction port is located and at least one filter being located in a suction duct comprising the floor group and the inside of the carrier.

2. A circular knitting machine creel as defined in claim 1, a horizontally extending pipe being located between the air outlet port and the air-blast hose.

3. A circular knitting machine creel as defined in claim 1, the air-blast nozzles being essentially directed towards the bobbins.

4. A circular knitting machine creel as defined in claim 1, further comprising an additional air-blast nozzle directed to a floor area of the frame.

5. A circular knitting machine creel as defined in claim 1, further comprising an additional air-blast nozzle directed to an upper area of the frame and to yarn-guiding tubes extending above the frame.

6. A circular knitting machine creel according to claim 2, in which the carrier is approximately the height of the frame, the blower being located at the top of the carrier and the air-blast hose extending downwardly from the pipe.

7. A circular knitting machine creel according to claim 2, in which the carrier is about half the height of the frame, the blower being located at the top of the carrier and the pipe ending in the centre of the air-blast hose.

8. A circular knitting machine creel as defined in claim 1, wherein the air outlet port ends at the bottom in the air-blast hose and supports the air-blast hose.

9. A circular knitting machine creel as defined in claim 1, wherein the blower housing carries a counterweight diametrically opposite the air-blast hose.

10. A circular knitting machine creel as defined in claim 1 further comprising a further air-blast hose attached to the blower housing, constructed similarly to the first air-blast hose, the air-blast hoses being located diametrically opposite one another.

11. A circular knitting machine creel as defined in claim 10, the blower having two opposite air outlet connections to which the air-blast hoses are attached.

12. A circular knitting machine creel as defined in claim 1, the blower housing together with the electric motor being rotatably supported by the carrier, the motor being supplied with power via slip-rings between the carrier and the blower housing.

13. A circular knitting machine creel as defined in claim 1, in which the electric motor being rigidly connected to the carrier.

14. A circular knitting machine creel according to claim 12, wherein the blower housing is rotated by a drive motor which is located on the carrier and is engaged with a drive rim on the blower housing.

15. A circular knitting machine creel according to claim 13, wherein the blower housing is rotated by a drive motor which is located on the carrier and is engaged with a drive rim on the blower housing.

16. A circular knitting machine creel as defined in claim 12, wherein the blower housing is rotated by at least one tangentially aligned blast nozzle on the air-blast hose.

17. A circular knitting machine creel as defined in claim 13, wherein the blower housing is rotated by at least one tangentially aligned blast nozzle on the air-blast hose.

18. A circular knitting machine creel as defined in claim 1, wherein the blower housing has several impellers with radially aligned axes which roll off a blade rim of the carrier.

19. A circular knitting machine creel as defined in claim 1, wherein the floor group is comprised of segments.

20. A circular knitting machine creel as defined in claim 1, wherein the floor group and the carrier provides a connection between the filter box and the suction port of the blower housing.

21. A circular knitting creel as defined in claim 19, wherein the floor group ends in a filter box and the carrier provides a connection between the filter box and the suction port of the blower housing.

22. A circular knitting creel as defined in claim 1, wherein the floor group ends in the carrier and supports a filter on its outer edge.

23. A circular knitting machine creel as defined in claim 19, wherein the floor group ends in the carrier and supports a filter on its outer edge.

24. A circular knitting machine creel as defined in claim 22, wherein the filter surrounds the floor group in the form of a ring.

25. A circular knitting machine creel as defined in claim 24, wherein the filter is placed at the front on the floor group.

26. A circular knitting machine creel as defined in claim 1, a carriage supporting a further blower for being guided on the outside of the frame and circulating around the frame.

27. A circular knitting machine creel as defined in claim 19, the segments inclining from the outside inward.

28. A circular knitting machine creel as defined in claim 19, including a cover plate circulating with the air-blast hose which covers segment openings for concentrating suction air on segments not covered by the cover plate.

* * * * *